US010808495B2

(12) United States Patent
Gano et al.

(10) Patent No.: US 10,808,495 B2
(45) Date of Patent: Oct. 20, 2020

(54) DEPLOYING SEALANT USED IN MAGNETIC RHEOLOGICAL PACKER

(71) Applicant: Halliburton Energy Services, Inc., Houston, TX (US)

(72) Inventors: John Charles Gano, Lowry Crossing, TX (US); Thomas Jules Frosell, Irving, TX (US); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/571,666

(22) PCT Filed: Sep. 15, 2016

(86) PCT No.: PCT/US2016/052011

§ 371 (c)(1),
(2) Date: Nov. 3, 2017

(87) PCT Pub. No.: WO2018/052431

PCT Pub. Date: Mar. 22, 2018

(65) Prior Publication Data

US 2019/0128090 A1 May 2, 2019

(51) Int. Cl.
*E21B 33/13* (2006.01)
*E21B 33/12* (2006.01)

(52) U.S. Cl.
CPC ..... *E21B 33/13* (2013.01); *E21B 33/1208* (2013.01)

(58) Field of Classification Search
CPC ..... E21B 33/13; E21B 33/1208
See application file for complete search history.

(56) References Cited

U.S. PATENT DOCUMENTS 4,161,984 A * 7/1979 Watkins ..... E21B 23/02 166/217
5,303,775 A * 4/1994 Michaels ..... E21B 49/10 166/264
6,283,218 B1 * 9/2001 Collins ..... E21B 23/02 166/115
7,428,922 B2 9/2008 Fripp et al.
7,743,825 B2 6/2010 O'Malley et al.
2009/0173500 A1 * 7/2009 Orban ..... E21B 33/138 166/298
2015/0315868 A1 * 11/2015 Fripp ..... E21B 33/10 166/387
2015/0345250 A1 12/2015 Murphree et al.
2017/0191341 A1 * 7/2017 Fripp ..... E21B 23/06

* cited by examiner

*Primary Examiner* — Crystal J Miller
(74) *Attorney, Agent, or Firm* — Locke Lord LLP

(57) ABSTRACT

Certain embodiments are directed to magnetic rheological packer systems that seal an annulus in a downhole wellbore. In one embodiment, the seal is formed from a two-part epoxy and magnetorheological composition. The epoxy and magnetorheological compositions are allowed to be shaped by a magnetic field provided by one or more magnets exerting a magnetic field to place the packer seal.

18 Claims, 3 Drawing Sheets

DEPLOYING SEALANT USED IN MAGNETIC RHEOLOGICAL PACKER

BACKGROUND

This disclosure relates generally to equipment utilized and operations performed in conjunction with a subterranean well and, as more fully described below, particularly relates to efficient packer systems and methods of containing and deployment of sealant compositions from packers within a wellbore.

It is a common practice to temporarily or otherwise isolate wellbore zones during the drilling and completion of wellbores. The zones are isolated from one another in order to prevent cross-flow of fluids from the rock formation and other areas into the annulus of the well. Isolation of the zones can be achieved, for example, by packer systems and/or devices.

Packer systems vary greatly and are among the most important tools in the tubing string. A variety of packer systems are used in wellbores to isolate specific wellbore regions. The basic requirement of a packer is to seal off an annulus. It is beneficial if the packers have a small outer diameter and length, so that fluid can bypass them, prior to the packer being activated. Once a packer is activated, there should be no fluid flow past the packer, as that is the purpose of the packer (i.e., isolation).

It would be advantageous to minimize the wall thickness and length of the packer device. The packer devices and methods disclosed herein help create simple deployment methods and lower the costs of well systems.

BRIEF DESCRIPTION OF THE DRAWINGS

Certain embodiments of the disclosed embodiments will hereafter be described with reference to the accompanying drawings, wherein like reference numerals denote like elements and.

DETAILED DESCRIPTION

Figure 1:
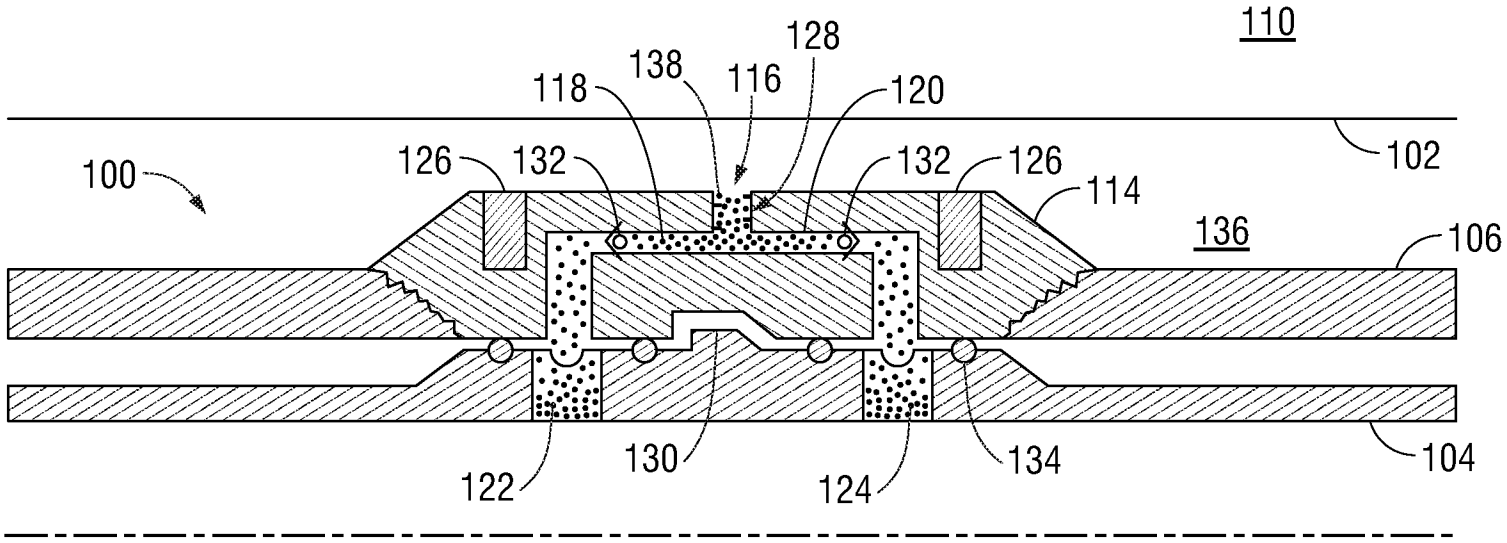
FIG. 1 is a side schematic cross-sectional view of a magnetic rheological ("MR") packer system with sealant compositions according to one aspect of the present disclosure.

In the following description, numerous details are set forth to provide an understanding of the disclosed embodiments. However, it will be understood by those of ordinary skill in the art that the disclosed embodiments may be practiced without these details and that numerous variations or modifications from the described embodiments may be possible.

The instant disclosure is directed to packer systems and methods of containing and deployment of sealant compositions from them. These systems and methods can be deployed downhole in a well system. For example, there is provided a packer system that can be deployed downhole, even in gravel and other debris environment, and that can effectively be set to maintain a desired annulus seal. In this regard, some wells that traverse subterranean formations may be filled with gravel and other debris that can prevent a packer from creating the desired and proper seal. Packers that can create a zonal isolation through a gravel pack or that can be set in more aggressive and debris-filled environments would be useful. Accordingly, improved packers systems, methods of containing, and deployment of sealant compositions from such systems and methods are disclosed herein.

The embodiments described herein provide, among other things, simple deployment methods and low cost packer systems, and also help avoid the risk of "gluing" a service tool in place.

According to an embodiment, the packer system can contain sealant compositions comprising magnetic rheological or magnetorheological fluids, sometimes referred to as MR fluids herein. The magnetic rheological or MR packer system may comprise magnetorheological fluids that contain magnetic particles suspended in sealant compositions. The sealant compositions can be oil or water-based including natural hydrocarbon oils, synthetic hydrocarbon oil, silicone oil, fresh water, and brines. Additives such as surfactants, viscosifiers, and/or suspension agents may also be added in some embodiments.

When a magnetorheological fluid is subjected to a magnetic field, it is possible to increase the apparent viscosity of the fluid such that a viscoelastic solid seal can be formed. Subjection of the fluid to a magnetic field is commonly referred to as putting the seal in an "on position" and the absence of a magnetic field is referred to as putting the seal in an "off position." The rheological properties manifested in the "on position" and "off position" are both quickly and completely reversible.

The yield strength of the seal can be controlled by changing certain parameters, such as concentration of magnetic particles, strength of the magnetic field, concentration of various additives, and gap width of the magnetic field. The downhole yield strength of the seal in the "on position" can also be increased by increasing the length of wellbore coverage.

These illustrative examples are not intended to limit the scope of the disclosed concepts. The following sections describe various additional aspects and examples with reference to the drawings in which like numerals indicate like elements, and directional descriptions are used to describe the illustrative aspects. The following sections use directional descriptions such as "above," "below," "upper," "lower," "upward," "downward," "left," "right," "uphole," "downhole," etc., in relation to the illustrative aspects as they are depicted in the Figures, the upward direction being toward the top of the corresponding figure and the downward direction being toward the bottom of the corresponding figure, the uphole direction being toward the surface of the well and the downhole direction being toward the toe of the well. Like the illustrative aspects, the numerals and directional descriptions included in the following sections should not be used to limit the present disclosure.

According to an embodiment, the disclosed MR packer system's seal can be formed in response to magnetic forces exerted by magnets that may be included either within the MR packer, on the MR packer, or otherwise near the location where the MR packer is located. Forming the packer seal in response to magnetic forces exerted by magnets can allow a seal to be formed without a hydraulic squeeze or other force that is typically used to form a packer seal. In addition, although there technically is a very low pressure "seal"

before the sealants cure or otherwise set, the magnets direct and maintain the sealant's location until it can cure, thereby creating a true seal.

FIG. 1 is a side schematic cross-sectional view of the disclosed MR packer system 100 with sealant compositions according to one aspect of the present disclosure. The MR packer system 100 is depicted in a substantially horizontal section of a wellbore 102 in a subterranean formation 110. Although FIG. 1 depicts the MR packer system in the substantially horizontal section of wellbore 102, additionally or alternatively, it may be located in a substantially vertical wellbore 102 section (not shown). Moreover, the MR packer system 100 can be disposed in simpler wellbores, such as wellbores having only a substantially vertical section, in open-hole environments, such as is depicted in FIG. 1, or in cased wells. The MR packer system can be used in injection wells, water wells, geothermal wells without hydrocarbon, carbon sequestration, monitoring wells, or any other appropriate downhole configuration in combination with any type of injection fluid, such as water, steam, carbon dioxide, nitrogen, or any other appropriate fluid.

The MR packer system 100 may be attached to a tubing 106 which may be part of a tubing string that extends from the surface to the subterranean formation 110 and contains at least one packer body 114 comprising at least one exit port 116 that is in fluid communication with sealant conduits 118, 120 within the packer body 114. A single sealant conduit (not shown) may also be used instead of two separate sealant conduits 118, 120 in some embodiments. It is contemplated that the packer body 114 may be a modified coupling, sleeve, or ring as known in the art and can be a part of, or a connection to a tubing string for operation in the well.

In the example of FIG. 1, the separate sealant conduits 118, 120 are designed to transport separate sealant compositions 122, 124, for example, two-part set-up sealant compositions (as more fully described below) that are mixed in a static mixer 128 prior to deployment from exit port 116. However, a single composition sealant may also be deployed via either a single sealant conduit setup or the two separate sealant conduits 118, 120. Notably, the packer body 114 contains at least one magnet 126, when magnetic rheological compositions are use.

The tubing 106 can provide a conduit for formation fluids, such as production fluids produced from the subterranean formation 110, to travel to the surface (not shown). Pressure in the wellbore 102 from the subterranean formation 110 can cause formation fluids, including production fluids such as gas or petroleum, to flow to the surface.

The MR packer system 100 may be designed to seal the wellbore 102 by utilizing sealant compositions 122 and 124 that are stored in the sealant conduits 118 and 120 within the packer body 114. The deployment of the sealant compositions 122 and 124 can be initiated by a signal or tool as known in the art.

According to an embodiment, the sealant compositions 122, 124 are, for example, a two-part epoxy composition. Accordingly, sealant composition 122 and sealant composition 124 are provided via separate sealant conduit 118 and sealant conduit 120. According to an embodiment, the two-part set-up sealant compositions 122, 124 are mixed as they pass through a static mixer 128 on their way to exit port 116 and into the annulus 136. The two-part set-up sealant compositions 122, 124 are carried downhole as separate compositions and can be mixed immediately prior to use.

The use of one-part sealant compositions is also contemplated herein. Examples of such sealant compositions include silicone, polyurethane and the like.

According to an embodiment, the sealant carrier fluid may be a polymer precursor. The polymer precursor may be a material that forms cross-links. Non-limiting examples of polymer precursors that may be used in connection with this disclosure include but are not limited to plastics, adhesives, thermoplastics, thermosetting resins, elastomeric materials, polymers, epoxies, silicones, sealants, oils, gels, glues, acids, thixotropic fluids, dilatant fluids, or any combinations thereof. The polymer precursor may be a single part polymer precursor (e.g., a moisture or UV cure silicone). Alternatively, the polymer precursor may be a multi-part polymer precursor (e.g., a vinyl addition or a platinum catalyst cure silicone).

According to an embodiment, the two-part set-up sealant compositions 122, 124 are provided via service tool 104 having, for example, a nipple profile 130, seals 134, and the like as known in the art and as needed to provide fluid communication when contacted with packer body 114, as depicted in FIG. 1. When needed the two-part set-up sealant compositions 122, 124 can be pumped from service tool 104 into sealant conduits 118, 120 by suitable means. For example, pressure may be created within the inside diameter ("ID") of the service tool 104 to open relief valves, rupture disks, and the like, to allow the sealant to traverse from the service tool to the packer. As such, the service tool 104 can be used to deploy the sealants compositions 122, 124 into sealant conduits 118, 120.

In an embodiment, sealant conduits 118, 120 of the MR packer system 100 may contain a check valve 132 to control the release of the sealant compositions 122, 124 and to prevent wellbore fluid from entering the sealant conduits 118, 120.

In another embodiment, a magnetorheological fluid, which is a type of smart fluid, usually a type of oil containing magnetically responsive particles, may be provided in one or both of the sealant compositions 122, 124. When subjected to a magnetic field, this fluid greatly increases its apparent viscosity, to the point of becoming a viscoelastic solid. Importantly, the yield stress of the fluid when in its active ("on") state can be controlled very accurately by varying the magnetic field intensity. The result is that the fluid's ability to transmit force can be controlled with an electromagnet, which gives rise to many possible control-based applications.

Figure 4:
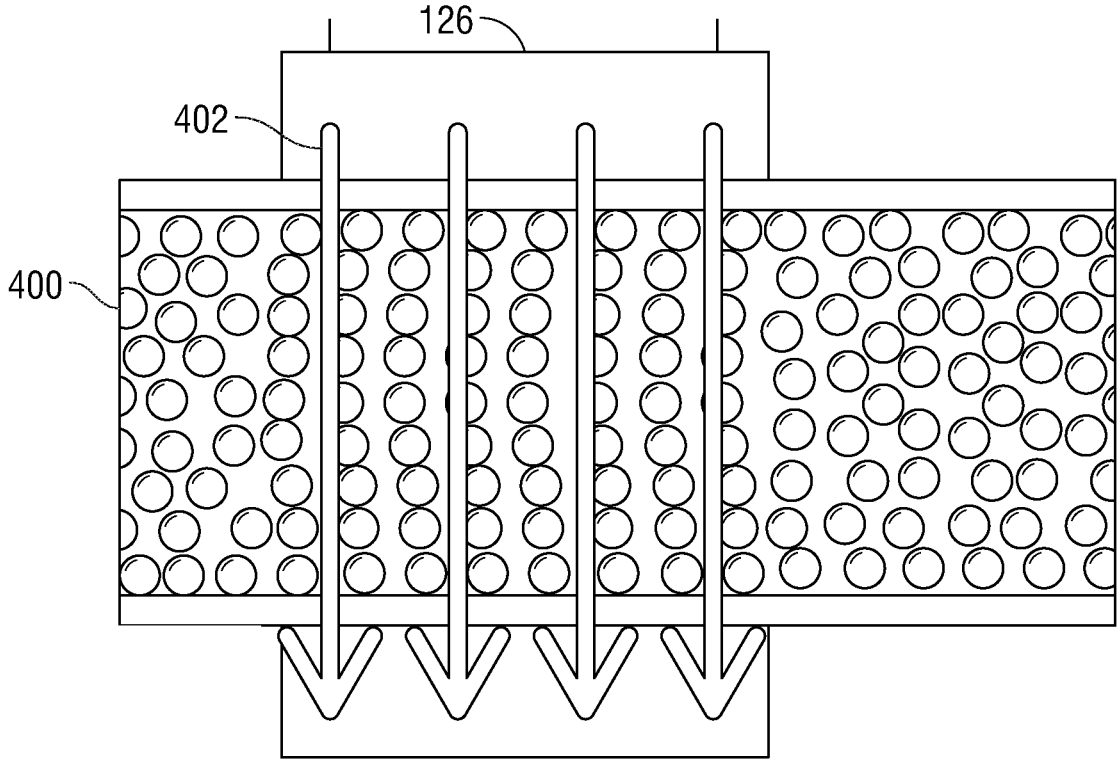
FIG. 4 a side-view schematic of a magnetorheological fluid solidifying and blocking a pipe in response to an external magnetic field.

Referring ahead to FIG. 4, an example of magnetically responsive particles 400 in a magnetorheological fluid aligning with a magnetic field 402 is shown. In FIG. 4, the magnetorheological fluid is depicted solidifying and thereby blocking an annulus (e.g., annulus 136 in FIG. 1) in response to an external magnetic field from the magnet 126.

MR fluid is different from a ferrofluid, which has smaller particles. MR fluid particles are primarily on the micrometer-scale and are too dense for Brownian motion to keep them suspended (in the lower density carrier fluid). Ferrofluid particles are primarily nanoparticles that are suspended by Brownian motion and generally will not settle under normal conditions.

The magnetically responsive particles mixed into one or both of the sealant compositions 122, 124 may be micrometer-scale. These magnetically responsive particles (which may also be referred to herein as magnetic particles for convenience) may be particles of a ferromagnetic material, such as iron, nickel, cobalt, any ferromagnetic, diamagnetic or paramagnetic particles, any combination thereof, or any other particles that can receive and react to a magnetic force. Any particles that are attracted to magnets can be used in the sealant compositions 122, 124 and are considered within the scope of this disclosure. Although the particles are primarily on the micrometer-scale, any suitable particle size may be used for the magnetically responsive particles. For example, the particles may range from the nanometer size up to the micrometer size. In one example, the particles may be in the size range of about 100 nanometers to about 1000 nanometers. In another example, the particles may range into the micrometer size, for example up to about 100 microns. It should be understood that other particles sizes are possible and considered within the scope of this disclosure. In embodiments where the particles are referred to as "nanoparticles," it should be understood that the particles may also be of micron sizes, or a combination of nanoparticles and microparticles. The particles can also be any shape, non-limiting examples of which include spheres, spheroids, tubular, corpuscular, fiber, oblate spheroids, or any other appropriate shape. Multiple shapes and multiple sizes may be combined in a single group of particles.

Passage of the magnetically responsive particles in one or both of the sealant compositions 122, 124 through a magnetic field causes the magnetically responsive particles to align with the magnetic field. The magnetic field may be created by one or more magnets 126. While an electromagnet could be used to provide the magnetic field, it is not necessary. Using two magnets 126 can allow the shape of the packer seal (not shown) to be adjustable via providing various magnet positions within or along the packer body 114. The term "magnet" is used herein to refer to any type of magnet that creates a radially extending magnetic field, and includes but is not limited to disc magnets, ring-shaped magnets, block magnets, or any other type of closed shape magnet. It is desirable for at least a portion of the magnetic field to extend radially from the magnets 126. According to an embodiment, the magnets project a magnetic field within the packer body 114 that encompasses the sealant conduits 118, 120.

Alignment of the magnetically responsive particles with the magnetic field of the magnets 126 causes the magnetic particles to hold the sealant compositions 122, 124 between the magnets. Subsequent movement of the sealant compositions 122, 124 is limited due to the alignment of the particles. FIG. 1 shows magnets 126 positioned within packer body 114, but the magnets 126 may be positioned on the outside of the packer body 114, or run down to the packer on a separate tool, or provided in any other configuration. The magnets 126 can be attached or otherwise secured to the packer body 114 via any appropriate method. Non-limiting examples of appropriate methods include adhesives, welding, mechanical attachments, embedding the magnets within the tubing, or any other option. Additionally, although two magnets 126 are shown for ease of reference, it should be understood that magnets 126 may each be a ring magnet positioned around the circumference of the packer body 114. Magnets 126 may be a series of individual magnets positioned in a ring around packer body 114. The general concept is that magnets 126 form a magnetic space therebetween that extends radially from the packer body 114. The magnetic space extends past the outer diameter of the packer body 114.

According to an embodiment, the magnets 126 can be positioned in or around packer body 114 so that their magnetic fields can affect the magnetically responsive particles in the sealant compositions 122, 124 upon deployment into the annulus 136. In a further option, the magnets 126 can be positioned or their magnetic fields can be adjusted so as to be near to the placement of the sealant compositions 122, 124 in the annulus 136. Alternatively, the driving force applied to the sealant compositions 122, 124 from service tool 104 may be sufficiently strong such that solidifying sealant compositions 122, 124 is expelled past the magnets 126, once the annular area between the magnets has been filled with sealant. The sealant compositions 122, 124 may be actively or passively deployed into the annulus 136 where they become combined or otherwise mixed together, indicated at 138. In some embodiments, instead of using a pressure differential across the completion to move/deploy the combined sealant compositions 138, an electronically triggered system may be used to activate the release of the fluid.

The sealant compositions 122, 124 are generally viscous or syrup-like and thus have flow and movement properties. The sealant compositions 122, 124 each may have a minimum yield stress before it begins to flow, such as Bingham plastic, and it may behave as a thixotropic material, such as a gel. The sealant compositions 122, 124 remain in a moveable form and are restricted by the magnetic field or magnetic space. In FIG. 1 deployment of the combined sealant compositions 138 is through exit port 116 upon the application of pressure to the sealant compositions 122, 124 in service tool 104. It should be understood that a passive deployment is also possible.

In FIG. 1, as the combined sealant compositions 138 flow out from exit port 116, the magnetically responsive particles are attracted by the magnets 126. If an initial flow is biased toward one side, e.g., toward the left magnet 126, the magnetic action from the right side magnet 126 may cause the combined sealant compositions 138 to move back toward a centralized position between the magnets. The interaction between the magnetically responsive particles and the magnets 126 causes the combined sealant compositions 138 to fill the area between the magnets 126 without moving very far past the magnets.

The halted movement of the combined sealant composition 138 allows it to create a packer seal (not expressly shown) between the packer body 114 and the subterranean formation 110 or wellbore 120. The magnetic force or field being exerted on the magnetically responsive particles holds the combined sealant compositions 138 within the magnetic field being exerted. The magnetic force changes the shear strength of the sealant compositions 122, 124 (and combined sealant compositions 138) from being more viscous to having a lower viscosity or being more solid-like.

Further, when two-part sealant compositions 122, 124 are used, for example, epoxy, glue, as well as those describe supra, the combined sealant compositions 138 cure or harden or otherwise create a packer seal (not expressly shown) that preferably provides for some movement, for example, thermal expansion to occur without loss of seal. The two-part sealant compositions 122, 124 may begin to cross-link and cure, for example, with the passage of time, applied heat, and/or exposure to certain fluids or environments that can cause the combined sealant compositions 138 to set and/or cure to form a seal (not expressly shown) in the desired location. For example, an elastomeric carrier may cure via vulcanization. A one-part epoxy may cure after a time being exposed to the wellbore fluids. A silicone sealant could be used as a one-part epoxy which sets and cures with exposure to water. A slow setting gel or other gel may set in the presence of water. Two-part systems generally cure due to a chemical reaction between the compositions to the two parts upon mixing. Other carriers/sealants may be used that cure based on temperature or any other environmental cue.

The present disclosure provides an MR packer system 100, in which the sealant compositions 122, 124 in the sealant conduits 118, 120 are passed into the annular space 136 via exit port 116 upon application of pressure. This also allows the packer seal (not shown) to be set in granular or other debris-filled environments.

If the magnetic field is increased, the movement of the combined sealant compositions 138 may become increasingly restricted. If the magnetic field is removed, the combined sealant compositions 138 may resume a more fluid-like or viscous-like state. This is generally the case with the combined sealant compositions 138 before they have begun to harden or otherwise create a packer seal.

Figure 2:
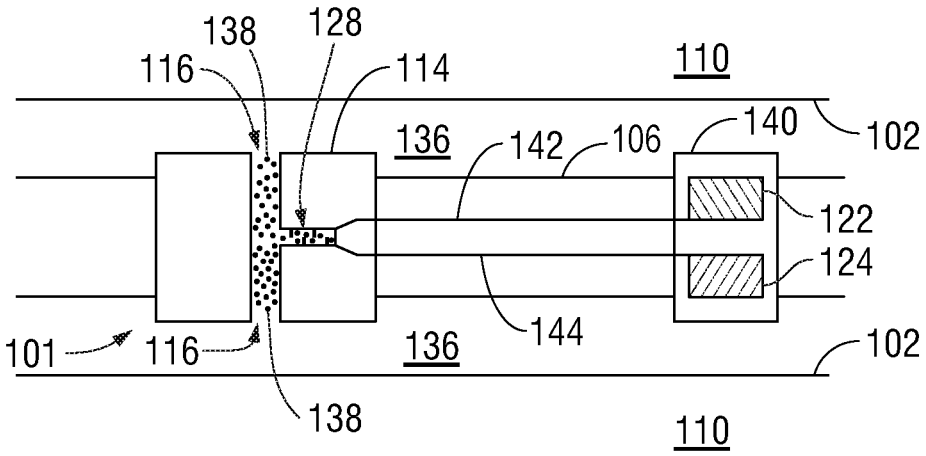
FIG. 2 is a side-view schematic of a MR packer system with sealant compositions according to one aspect of the present disclosure.

FIG. 2 is a side-view schematic of another MR packer system 101 with sealant compositions according to one aspect of the present disclosure. According to this embodiment, sealant compositions 122, 124 are placed in a separate sealant module 140. The sealant module 140 may be connected to tubing 106; however, the sealant module 140 is also connected to the packer body 114 via separate sealant composition control lines 142, 144. The control lines 142, 144 can be of any size or shape, as known in the art. In this regard control lines 142, 144 extend externally along the tubing 106 from the sealant module 140 to the packer body 114 and are configured for the passage of the separate sealant compositions 122, 124. The sealant module 140 may have a nipple profile (not shown) located in it to allow for a service tool (not shown) to apply hydraulic or mechanical pressure to move the sealant compositions 122, 124 from the sealant module 140 to the packer body 114. The sealant module 140 may have burst disks, or relief valves to allow a non-intervention method of moving the sealant into the packer body 114. Because the MR packer system 101 provides for the sealant module 140 to be separate from the packer body 114, this allows packer body 114 to be less complex, shorter, and easier to deploy.

In FIG. 2, sealant compositions 122, 124 are mixed in the static mixer 128 and the combined sealant compositions 138 are deployed from exits 116 into annulus 136.

Although magnets are not displayed in FIG. 2, magnets 126 (as presented in FIG. 1) can be positioned within packer body 114. Additionally, in FIG. 2 the magnets may be positioned on the outside of the packer body 114, or run down on a separate tool, or provided in any other configuration. The magnets can be attached or otherwise secured to the packer body 114 via any appropriate method.

Figure 3:
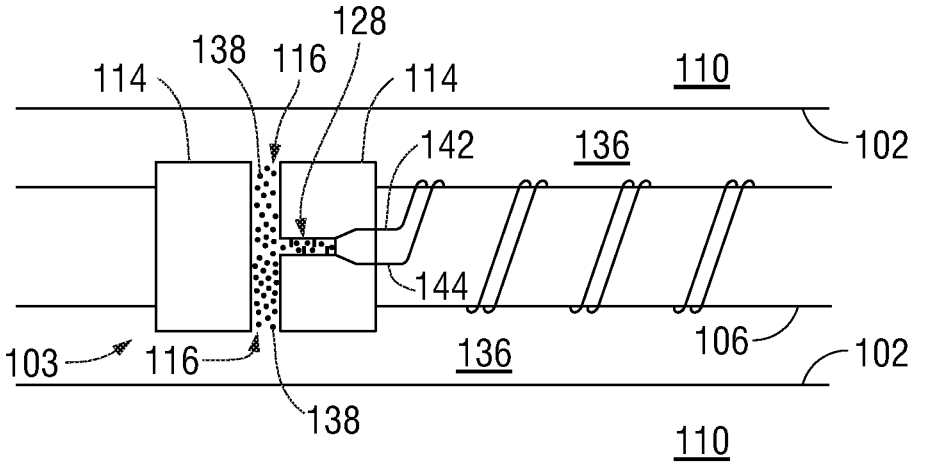
FIG. 3 is a side-view schematic of a MR packer system with sealant compositions according to one aspect of the present disclosure.

FIG. 3 is a side-view schematic of the yet another MR packer system 103 with sealant compositions according to one aspect of the present disclosure. According to this embodiment, the MR packer system 103 uses the separate sealant composition control lines 142, 144 to store the sealant compositions 122, 124. The control lines 142, 144 can be wrapped around the tubing 106 in a non-screen handling room section between any joint.

The amount of sealant compositions 122, 124 stored in control lines 142, 144, and hence the number of wraps, can be determined as needed. For example, if 150 cubic inches of sealant is required, it would take 78 wraps of ⅜ inch ID control line to contain enough sealant on a 5.5 inch OD (outer diameter) pipe. In this example, with a ½ inch OD, the control line would take up about 39 inches of space. In calculating the quantity of sealant, the area A of a ⅜ inch circle is A=0.375^2*pi*0.25, and this area is multiplied by the number of wraps times the circumference of the pipe to get the volume V of sealant, V=A*78*5.5*pi=148.8 in^3. In this example there is a ⅜ inch inner diameter, so the tubing has a wall thickness of 1/16 inch.

In FIG. 3, sealant compositions 122, 124 are mixed in static mixer 128 and the combined sealant compositions 138 are deployed from exits 116 into annulus 136. In this embodiment, control lines 142, 144 can terminate into a short module (not shown) on the packer body 114 with a nipple profile (not shown) for service tool actuation, or control lines 142, 144 can be wrapped back to the MR packer 114 and the service tool could actuate there.

Although magnets are not displayed in FIG. 3, magnets 126 (as presented in FIG. 1) can be positioned within packer body 114. Additionally, in FIG. 3 the magnets may be positioned on the outside of the packer body 114, or run down on a separate tool, or provided in any other configuration. The magnets can be attached or otherwise secured to the packer body 114 via any appropriate method.

Although shown and described with two magnets 126 in FIG. 1 (or a series of two rows of magnets that generally create a magnetic field therebetween), it is possible for the MR packer systems disclosed herein to be deployed with a single magnet. For example, a vertical assembly may have a single magnet. The sealant compositions 122, 124 would flow down via natural gravity, and a lower magnet may be used to constrain the combined sealant compositions 138 flow due to gravity and thus maintain the combined sealant compositions 138 in the desired location. The same arrangement may also work in a horizontal assembly.

According to an embodiment, the subterranean formation 110 can be permeable and the combined sealant compositions 138 with magnetically responsive particles may enter a short distance into the permeable subterranean formation 110. This can extend the packer seal provided by the MR packer system (100, 101, 103) beyond the annulus 136 and into the subterranean formation 110. Creating such a seal into the formation may help decrease the likelihood of bypassing the MR packer system's packer seal. A packer seal that creates a deep seal that extends into the formation can accommodate a shorter packer than a normal swell packer.

The pressure holding capability of the packer seal of the MR packer system 100, 101, 103 described herein can vary depending on how the compositions are used to provide the packer seal. These parameters may be modified depending upon the desired use and pressure requirements.

The MR packer systems discussed in the above disclosure are generally designed to be a permanent set packer. However, if the sealant compositions 122, 124 are chosen to have minimal yield strength when set, then the MR packer systems' packer seal can be made into a retrievable packer.

Varying the magnetic field may also allow for an alternative deployment of the sealant compositions 122, 124 (and the combined sealant compositions 138). In one variation, there may be a lower magnetic field during deployment of the sealant compositions 122, 124 (and the combined sealant compositions 138). With less magnetic flux, the sealant compositions 122, 124 (and combined sealant compositions 138) are less constrained and flow more easily. As a result, the combined sealant compositions 138 are more likely to penetrate deeper into the subterranean formation 110 and to create a zonal isolation that is deeper than the annulus 136 to be sealed. This may be accomplished via varying the magnetic field using any appropriate method. In a further variation, there may be a stronger magnetic field in place during the deployment of the carrier fluid.

Various modifications to the sealant compositions 122, 124 can be made in order to minimize settling of the particles in the combined sealant compositions 138. Iron particles are generally heavier than epoxy, but for example, if the sealant compositions 122, 124 are chosen to have a similar density to the particles, settling or early solidifying of the particles can be minimized A yield stress within the sealant compositions 122, 124 can also help to minimize settling. Settling can be minimized by one or more of: using smaller particle sizes, sending the solution of particles through a static mixer during the injection process, and/or mixing a highly concentrated solution of particles with the carrier fluid during the injection process. Use of a highly concentrated solution with a high yield strength may help prevent settling of the particles, as the sealant compositions 122, 124 may dilute the high yield strength to allow for easier flow through the gravel pack and into the formation. Agglomeration of the particles can be minimized by using a dispersant or surfactant, such as soap, in the fluid. The surface of the particles may be functionalized, such as with siloxane, in order to enhance the bonding between the particles and the crosslinking carrier fluid.

The performance of the magnets can be enhanced by creating a situation where there is compressive locking of the particles. Tapering the exterior of the service tool at the magnet portions may help to form a compressive lock within the particles. The shape of the actual particles may be altered in an effort to create better internal locking of the particles. For example, while round particles may be used, elongated or rod-shaped particles may lock more securely and create a stronger packer in place. The particles can be shaped to better entangle with one another to form the packer seal. The length of the particles may also be modified to provide varying locking configurations. It is believed that a particularly useful length may be from about 10 nanometers to about 1 millimeter, although other options are possible and within the scope of this disclosure.

Accordingly, as set forth above, the embodiments disclosed herein may be implemented in a number of ways. In one embodiment, a packer system as disclosed herein for use downhole in a wellbore may comprise a packer body having an exterior and interior side, the interior side being proximate to an exterior side of a tubing section. The packer body comprises at least one conduit having an input opening and an output opening, and a tool to access the input opening of the conduit and cause deployment of a sealant composition into the conduit. Deployment of the sealant composition through the conduit causes the sealant composition to exit the packer body through at least one exit on the exterior side of the packer body filling a space between the packer body and the wellbore.

In another embodiment, a packer system as disclosed herein for use downhole in a wellbore may comprise a packer body having an exterior and interior side, the interior side being proximate to an exterior side of a tubing section. The packer body comprises at least two conduits each having an input opening and an output opening, and a tool to access the input openings of the conduits and cause deployment of a sealant composition into the conduits. Deployment of the sealant composition through the conduits causes the sealant composition to exit the packer body through at least one exit on the exterior side of the packer body filling a space between the packer body and the wellbore.

In yet another embodiment, a method as disclosed herein for forming a downhole packer seal in a wellbore may comprise providing a radially extending magnetic force field from a packer body and deploying at least one sealant composition from the packer body comprising magnetically responsive particles. The magnetically responsive particles are constrained by the magnetic force field, allowing the at least one sealant composition to cure to form a packer seal.

In yet another embodiment, a packer system as disclosed herein for use downhole in a wellbore may comprise a packer body having an exterior and interior side, the interior side being proximate to an exterior side of a tubing section. The packer body comprises at least one packer conduit having an input opening and an output opening in fluid communication with at least one exit to the exterior side of the packer body, and a sealant module proximate to the exterior side of the tubing section comprising at one least sealant compartment containing sealant composition, said compartment comprising a module conduit in fluid communication with the input opening. Deployment of the sealant composition from the sealant compartment through module conduit and packer conduit causes the sealant composition to exit through the at least one exit filling a space between the packer body and the well bore.

In yet another embodiment, a packer system as disclosed herein for use downhole in a wellbore may comprise a packer body having an exterior and interior side, the interior side being proximate to an exterior side of a tubing section. The packer body comprises at least one conduit comprising a sealant composition and having an output opening in fluid communication with at least one exit to the exterior side of the packer body. Deployment of a sealant composition from the packer conduit through the exit causes the sealant composition to fill a space between the packer body and the wellbore.

In yet another embodiment, a packer system as disclosed herein for use downhole in a wellbore may comprise a packer body having an exterior and interior side, the interior side being proximate to an exterior side of a tubing section. The packer body comprises at least one packer conduit having an input opening and an output opening in fluid communication with at least one exit to the exterior side of the packer body, and at least one module conduit proximate to the exterior side of the tubing section comprising a sealant composition and in fluid communication with the input opening. Deployment of the sealant composition from module conduit through packer conduit causes the sealant composition to exit through the at least one exit filling a space between the packer body and the well bore.

In the foregoing embodiments, any one or more of the following features may be implemented. The one or more magnets may be positioned on or within the packer body. The sealant composition may comprise magnetically responsive particles. The input opening may be accessible from an inside area of the tubing section. The input opening may be accessible from the exterior side of the packer body. The sealant composition may comprise at least one of a plastic, adhesive, thermoplastic, thermosetting resin, elastomeric material, polymer, epoxy, silicone, sealant, oil, gel, glue, acid, thixotropic fluid, dilatant fluid, or any combination thereof. The magnetically responsive particles may comprise at least one of iron, nickel, cobalt, diamagnetic particles, paramagnetic particles, or any combination thereof. The packer body may be a modified coupling, sleeve, or ring. The sealant composition after exiting the packer body may create a packer seal upon cure of the sealant composition in the space. The sealant composition upon exiting the packer body may be under the influence of the magnetic field from the one or more magnets. The packer body may be coaxial or eccentric to the tubing section.

The foregoing description, including illustrated aspects and examples, has been presented only for the purpose of illustration and description and is not intended to be exhaustive or to limiting to the precise forms disclosed. Numerous modifications, adaptations, and uses thereof will be apparent to those skilled in the art without departing from the scope of this disclosure.

The invention claimed is:

1. A packer system for use downhole in a wellbore, comprising:

a packer body having an exterior side and an interior side and configured to be attached to a tubing section, the packer body comprising at least one conduit having an input opening and an output opening; and a tool positioned beside the tubing section to access the input opening of the conduit and cause deployment of a sealant composition into the conduit, the tool having a locating profile and seals for providing fluid communication with the packer body, the sealant composition comprising magnetically responsive particles;

wherein deployment of the sealant composition through the conduit causes the sealant composition to exit the packer body through at least one exit on the exterior side of the packer body filling a space between the packer body and the wellbore, wherein the packer body comprises at least two separate packer conduits, wherein the at least two separate packer conduits connect to a single static mixer configured for mixing sealant compositions.

2. The packer system of claim 1, wherein one or more magnets are positioned on or within the packer body.

3. The packer system of claim 1, wherein the input opening is accessible from an inside area of the tubing section.

4. The packer system of claim 1, wherein the input opening is accessible from the exterior side of the packer body.

5. The packer system of claim 1, wherein the sealant composition comprises at least one of a plastic, adhesive, thermoplastic, thermosetting resin, elastomeric material, polymer, epoxy, silicone, sealant, oil, gel, glue, acid, thixotropic fluid, dilatant fluid, or any combination thereof.

6. The packer system of claim 1, wherein the magnetically responsive particles comprise at least one of iron, nickel, cobalt, diamagnetic particles, paramagnetic particles, or any combination thereof.

7. The packer system of claim 1, wherein the packer body is a modified coupling, sleeve, or ring.

8. The packer system of claim 1, wherein the sealant composition after exiting the packer body creates a packer seal upon cure of the sealant composition.

9. The packer system of claim 1, wherein the sealant composition upon exiting the packer body is under the influence of a magnetic field from one or more magnets.

10. The packer system of claim 1, wherein the packer body is coaxial or eccentric to the tubing section.

11. A method for forming a downhole packer seal in a wellbore, comprising:

providing a radially extending magnetic force field from a packer body; and deploying at least one sealant composition from the packer body comprising magnetically responsive particles, such that the magnetically responsive particles are constrained by the magnetic force field, allowing the at least one sealant composition to cure to form a packer seal;

wherein the packer body has an exterior side and an interior side and is configured to be attached to a tubing section, the packer body comprising at least one conduit having an input opening and an output opening;

wherein deployment of the sealant composition through the conduit causes the sealant composition to exit the packer body through at least one exit on the exterior side of the packer body filling a space between the packer body and the wellbore, wherein the packer body comprises at least two separate packer conduits, wherein the at least two separate packer conduits connect to a single static mixer configured for mixing sealant compositions; and wherein the at least one sealant composition is deployed into the conduit using a service tool positioned beside the tubing section to access the input opening of the conduit, the service tool having a locating profile and seals for providing fluid communication with the packer body.

12. The method of claim 11, wherein the sealant composition is deployed in an area of the wellbore that contains gravel and/or debris.

13. A packer system for use downhole in a wellbore, comprising:

a packer body having an exterior side and an interior side and configured to be attached to a tubing section, the packer body comprising at least one packer conduit having an input opening and an output opening in fluid communication with at least one exit to the exterior side of the packer body;

a sealant module proximate to the exterior side of the tubing section comprising at least one sealant compartment containing a sealant composition, the sealant composition comprising magnetically responsive particles and the compartment comprising a module conduit in fluid communication with the input opening, wherein deployment of the sealant composition from the sealant compartment through the module conduit and the at least one packer conduit causes the sealant composition to exit through the at least one exit filling a space between the packer body and the wellbore, wherein the packer body comprises at least two separate packer conduits, wherein the at least two separate packer conduits connect to a single static mixer configured for mixing sealant compositions; and a service tool positioned beside the tubing section and configured to cause deployment of the sealant composition from the sealant compartment through the module conduit and the at least two separate packer conduits.

14. The packer system of claim 13, wherein the sealant module comprises at least two sealant compartments and each sealant compartment comprises at least one module conduit in fluid communication with the input opening of the packer conduit.

15. The packer system of claim 13, wherein the output openings of the at least one packer conduit are in fluid communication with a common conduit area that is in fluid communication with the exit.

16. The packer system of claim 13, wherein the packer body comprises one or more magnets that border a space and create a radially extending magnetic field.

17. The packer system of claim 13, wherein deployment of the sealant composition through the separate module conduits and packer conduits causes the sealant compositions to enter a common conduit area and mix prior to exiting the common conduit area through the at least one exit where the sealant compositions are under the influence of a magnetic field from one or more magnets.

18. The packer system of claim 13, wherein at least one of the sealant compositions comprises magnetically responsive particles.

* * * * *